US005702088A

United States Patent [19]

Roberge

[11] Patent Number: 5,702,088

[45] Date of Patent: Dec. 30, 1997

[54] WINCH HANDLE

[76] Inventor: Paul Roberge, 281 Asby Rd., Ashburnham, Mass. 01430

[21] Appl. No.: 547,569

[22] Filed: Oct. 24, 1995

[51] Int. Cl.[6] ..... B66D 1/00

[52] U.S. Cl. ..... 254/266; 114/144 R; 254/371

[58] Field of Search ..... 114/144 R, 218; 74/552; 254/264, 266, 371

[56] References Cited

U.S. PATENT DOCUMENTS

| | | | |
|---|---|---|---|
| 4,479,616 | 10/1984 | Kovalovsky | 242/84.1 |
| 4,553,496 | 11/1985 | Foresman | 114/144 R |
| 4,582,298 | 4/1986 | Boome et al. | 254/266 |
| 5,048,799 | 9/1991 | Aronowitsch et al. | 254/344 |
| 5,255,573 | 10/1993 | Estabrook | 74/545 |

*Primary Examiner*—Katherine Matecki

*Attorney, Agent, or Firm*—Joseph H. McGlynn; Patent & Trademark Services, Inc.

[57] ABSTRACT

A method of attaching a handle to a halyard winch on a sail boat in order to increase the mechanical advantage of the handle. The method comprises removing the standard halyard winch handle, removing the standard ship's wheel, and placing the ship's wheel on the halyard winch in place of the halyard winch handle. Also, a device is used to attach the ship's wheel to the halyard winch which has a first end inserted into the halyard winch and a second end for securing the ship's wheel thereto. Turning the ship's wheel will turn the halyard winch, and since the ship's wheel is larger than a normal winch handle, a mechanical advantage will be realized.

4 Claims, 1 Drawing Sheet

WINCH HANDLE

BACKGROUND OF THE INVENTION

This invention relates in general to winches and in particular to a device for a winch on a ship that will increase the mechanical advantage of the winch.

DESCRIPTION OF THE PRIOR ART

In the prior art various types of mechanical winch handles, which can be used on sail boats have been proposed, however all of the prior art devices suffer the same type of drawbacks. Even though the prior art winches are designed with various types of mechanical advantages built in, people who are small in stature, such as children or women, have trouble turning the winch handles by hand to raise heavy loads. For example, U.S. Pat. No. 4,479,616 discloses an extendible crank handle which can be moved from a stowed position to an extended position and which offers the operator a mechanical advantage. U.S. Pat. No. 4,582,298 discloses a pedestal winch handle with a variable radius crank arm. U.S. Pat. No. 5,048,799 discloses a winch handle with a transmission ratio designed to impart a mechanical advantage to the winch handle. U.S. Pat. No. 5,255,573 discloses a manually operated winch crank with a rotatable handle.

SUMMARY OF THE INVENTION

The present invention is directed to increasing the mechanical advantage of a winch used on a sail boat so people who are small in stature may use the winch to lift heavy loads. It is particularly advantageous when used with a device known as a bosun's chair.

Although there are various types of winch handles which increase the mechanical advantage of the handle, as pointed out above, they are expensive and take up additional room, which is at a premium on a sail boat. However, many sail boats already have a handle on board which possesses a large mechanical advantage when compared to the ordinary winch handle. Many ships have a standard 30 inch ship's wheel which offers a large mechanical advantage when compared with the standard 10 inch winch handle on the halyard winch.

The present invention is used by removing the standard ship's wheel, and placing the ship's wheel on the halyard winch.

It is an object of the present invention to provide a inexpensive replacement for a standard halyard winch handle on a sail boat which offers a significant mechanical advantage.

These and other objects and advantages of the present invention will be fully apparent from the following description, when taken in connection with the annexed drawings.

DESCRIPTION OF THE PREFERRED EMBODIMENT

Figure 1:
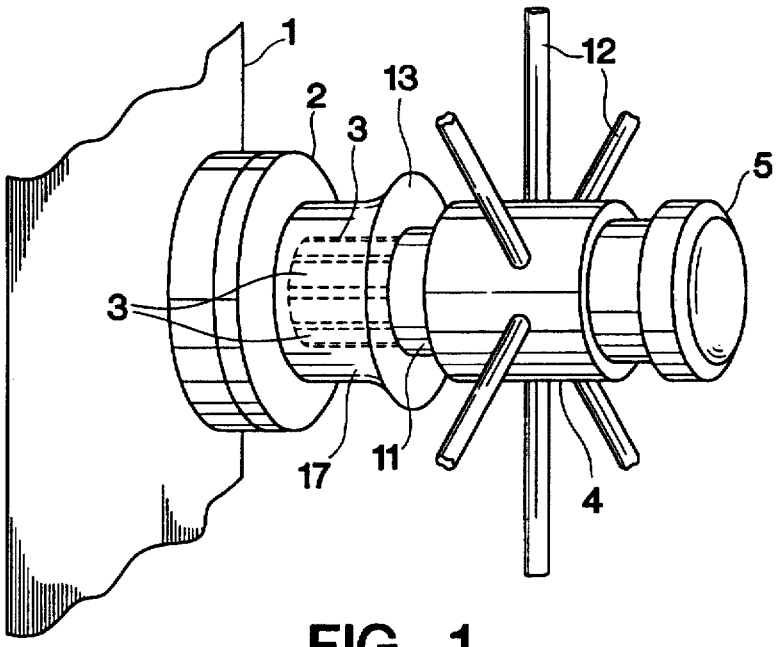
FIG. 1 is a view of a sail boat mast with the halyard winch, the device known as the Bosun's Buddy engaged into the winch and a ship's wheel mounted to the winch by means of the Bosun's Buddy.

Referring now to the drawings in greater detail, FIG. 1 shows a sail boat mast 1 having a halyard winch 2 in their normal positions on a sail boat. Attached to the winch is the Bosun's Buddy 6 which is secured to the winch by means of the splines 3 which are inserted into the socket 13 of the winch, as will be explained in more detail below. The standard ship's wheel 4, which has approximately a 30 inch diameter, with spokes 12 attached thereto is secured to the Bosun's Buddy 6 by nut 5.

Figure 2:
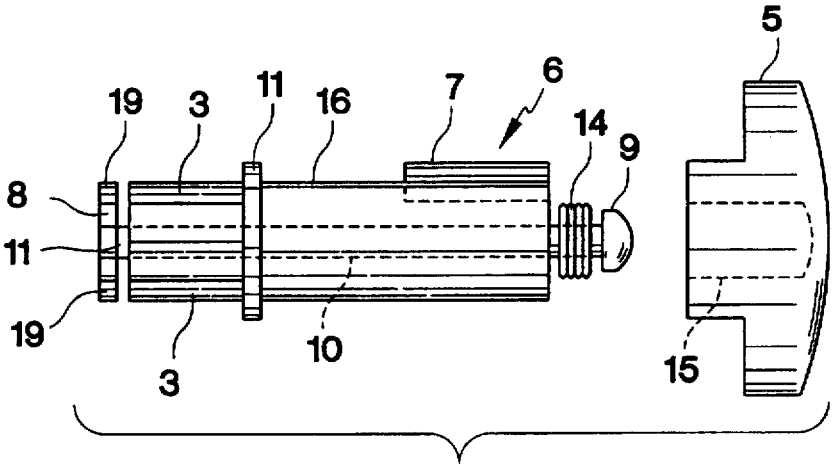
FIG. 2 is a side view of the Bosun's Buddy complete with a self locking disc-shaft and wheel retainer.

FIG. 2 shows the device known as the Bosun's Buddy 6. It has a plurality of splines 3 at one end which will engage into the socket 13 on the winch 2. A shaft 10 runs from one end of the Bosun's Buddy to the other end. Next to the splines 3, the shaft is connected to a disk 8 which has splines 19 to match splines 3. A spring 11 is connected between disk 8 and the portion that contains splines 3. At the other end shaft 10 has a threaded portion 14 that will engage with an internally threaded aperture 15 in nut 5. Also on the end of shaft 10 is a nut 9 secured to the shaft by standard screw threads (not shown).

Figure 3:
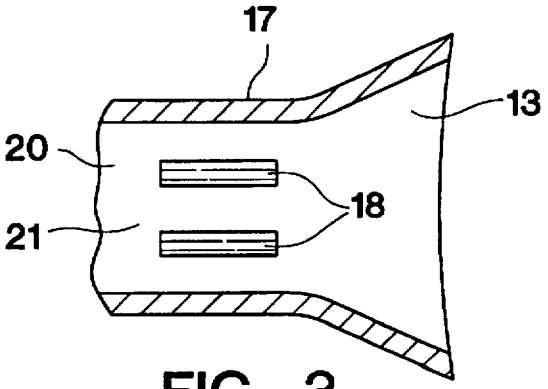
FIG. 3 is a sectional view of the socket of the halyard winch.
Figure 4:
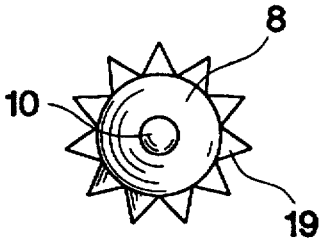
FIG. 4 is a plan view of the disk on the end of the Bosun's Buddy.

By rotating nut 9 counter clockwise with one hand while holding the Bosun's Buddy with the other hand, the shaft 10 will turn in the same direction. This will turn disk 8 against the bias of spring 11 until the splines 19 on disk 8 align with splines 3. The Bosun's Buddy will now be inserted into the socket 13 of winch 2. The aligned splines 3 and 19 will enter into the spaces 21 (see FIG. 3) between the splines 18 which are spaced around the inner circumference of socket 13 in winch 2. When the Bosun's Buddy is fully inserted into the socket, the forward end of splines 3 will be approximately even with the inner most end of splines 18, and the disk 8 will be positioned in the space 20. When nut 9 is released, the disk 8 will rotate back under the force of spring 11, thereby misaligning the splines 19 with the spaces 21 which will prevent the Bosun's Buddy from coming out of the socket 13. The splines 3 will be positioned in the spaces 21 between the splines 18, so when the wheel 4 is turned the engagement between the splines 3 and the splines 18 will turn the winch 2.

The ship's wheel 4 will be secured to the steering mechanism of the boat by a spline and nut similar to the spline 7 and nut 5, shown in FIG. 2. When extra leverage is needed the nut 5 is removed, the wheel is removed and placed onto the Bosun's Buddy. Spline 7 will engage a conventional internal keyway (not shown) on the wheel 4. This will prevent the wheel from turning with respect to the Bosun's Buddy. Next the nut 5 is placed onto threaded portion 14 to secure the wheel.

Since the ship's 30 inch wheel 4 has a larger diameter than the standard 10 inch winch handle, the halyard winch will be able to move heavier loads, due to the mechanical advantage imparted by the larger wheel.

It should be noted that the Bosun's Buddy is not used only for hauling a person aloft on the bosun's chair to make repairs or unjam sails. The Bosun's Buddy can also be used in man over board situations, which will minimize the victim's time in the water, thus preventing possible hyperthermia, by eliminating two time consuming procedures:

1) attaching hoisting tackle to the halyard, and 2) properly adjusting tackle and halyard in order to haul victim back onto the deck.

Although the use of a ship's wheel instead of a halyard winch handle to turn the halyard winch according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A method for increasing the mechanical advantage of a halyard winch on a ship, the halyard winch having a socket attached thereto and a halyard winch handle having a first length received in the socket, said ship having a ship's wheel for steering said ship, said ship's wheel being attached to a steering mechanism by a retainer nut, said ship's wheel having a diameter which is larger than said first length of said halyard winch handle, and means for attaching said ship's wheel to said socket, said means having a first end and a second end, said method comprising:

inserting said first end of said means for attaching said ship's wheel into said socket attached to said halyard winch, placing said ship's wheel on said second end of said means, and securing said ship's wheel to said means by placing a nut on said second end, thereby securing said ship's wheel to said means, whereby since said ship's wheel has a diameter larger than said first length of said halyard winch handle, said halyard winch will have a mechanical advantage that will allow said halyard winch to move heavier objects.

2. A device for attaching a ship's wheel to a halyard winch, said halyard winch having a socket, said device comprising:

a body having a first end and a second end, said body having a plurality of spaced splines on said first end and an externally threaded portion adjacent said second end, locking means for locking said body into said socket, said body having a portion between said first and second ends, adapted to receive a ship's wheel, and means cooperating with said externally threaded portion for holding a ship's wheel on said body.

3. The device for attaching a ship's wheel to a halyard winch as claimed in claim 2, wherein said body has a projection means for engaging said ship's wheel for preventing relative rotation between said body and said ship's wheel.

4. The device for attaching a ship's wheel to a halyard winch as claimed in claim 2, wherein said locking means comprises a disk having a plurality of splines around its circumference, said splines being equal in number to said splines on said first end of said body, said splines on said disk and said splines on said body each have a width defined by a plurality of sides, a shaft connecting said disk with said body, a spring means connecting said disk to said body to normally hold said sides on said splines on said disk out of alignment with said sides on said splines on said body by a spring means, means for turning said disk to align said sides on said splines on said body with said sides on said splines on said disk, whereby said first end of said body is adapted to be inserted into said socket on said halyard winch with said splines aligned and then said splines are allowed to become unaligned by said spring means thereby securing said body into said socket on said halyard winch.

* * * * *